US010773121B2

(12) United States Patent
Del Monaco et al.

(10) Patent No.: US 10,773,121 B2
(45) Date of Patent: Sep. 15, 2020

(54) GYMNASTIC MACHINE HAVING A SLIDING BELT PROVIDED WITH A RESISTING DEVICE TO THE MOTION OF THE USER

(71) Applicant: TECHNOGYM S.P.A., Cesena FC (IT)

(72) Inventors: Alessandro Del Monaco, Cesena (IT); Ivan Lisi, Cesena (IT); Luca Bandini, Cesena (IT)

(73) Assignee: TECHNOGYM S.P.A., Cesena FC (IT)

( * ) Notice: Subject to any disclaimer, the term of this patent is extended or adjusted under 35 U.S.C. 154(b) by 78 days.

(21) Appl. No.: 16/130,529

(22) Filed: Sep. 13, 2018

(65) Prior Publication Data

US 2019/0083843 A1 Mar. 21, 2019

(30) Foreign Application Priority Data

Sep. 15, 2017 (IT) ..... 102017000103557

(51) Int. Cl.
*A63B 22/00* (2006.01)
*A63B 22/02* (2006.01)
(Continued)

(52) U.S. Cl.
CPC ..... *A63B 22/0089* (2013.01); *A63B 21/015* (2013.01); *A63B 21/0442* (2013.01);
(Continued)

(58) Field of Classification Search
CPC ..... A63B 21/00058; A63B 21/00069; A63B 21/00072; A63B 21/00178; A63B 21/00185; A63B 21/002; A63B 21/0023; A63B 21/012; A63B 21/0125; A63B 21/015; A63B 21/02; A63B 21/028;
(Continued)

(56) References Cited

U.S. PATENT DOCUMENTS 1,766,089 A 8/1928 Wood
2,017,128 A * 10/1935 O'Neill, Jr. ..... A63B 22/02 482/54

(Continued)

FOREIGN PATENT DOCUMENTS

DE 20 2011 103143 U1 6/2011

OTHER PUBLICATIONS

Search Report and Written Opinion for Italian Patent Application No. IT 201700103557, dated Apr. 17, 2018, in 6 pages.

*Primary Examiner* — Gary D Urbiel Goldner
(74) *Attorney, Agent, or Firm* — Knobbe, Martens, Olson & Bear, LLP

(57) ABSTRACT

The present invention relates to a gymnastic machine having a closed circuit sliding belt comprising a base structure, a sliding belt, sliding according to a sliding direction installed on the base structure upon which a user performs a gymnastic exercise, a supporting structure coupled to the base structure, a first and a second handle for supporting the user, coupled to the supporting structure, a resisting device wearable by the user, the gymnastic machine being characterized in that each of the first and second handles comprises a respective coupling member for coupling with the resisting device.

7 Claims, 7 Drawing Sheets

(51) Int. Cl.

| | |
|---|---|
| ***A63B 21/16*** | (2006.01) |
| ***A63B 21/015*** | (2006.01) |
| ***A63B 69/00*** | (2006.01) |
| ***A63B 21/055*** | (2006.01) |
| ***A63B 21/04*** | (2006.01) |
| ***A63B 23/04*** | (2006.01) |
| ***A63B 21/00*** | (2006.01) |

(52) U.S. Cl.
CPC ..... *A63B 21/0552* (2013.01); *A63B 21/16* (2013.01); *A63B 21/4009* (2015.10); *A63B 22/02* (2013.01); *A63B 22/0235* (2013.01); *A63B 22/0285* (2013.01); *A63B 23/047* (2013.01); *A63B 69/0057* (2013.01); *A63B 2210/50* (2013.01)

(58) Field of Classification Search
CPC . A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/065; A63B 21/068; A63B 21/15; A63B 21/151; A63B 21/154; A63B 21/155; A63B 21/156; A63B 21/159; A63B 21/16; A63B 21/22; A63B 21/4007; A63B 21/4009; A63B 21/4023; A63B 21/4025; A63B 21/4027; A63B 21/4033; A63B 21/4035; A63B 21/4039; A63B 21/4041; A63B 21/4045; A63B 21/4047; A63B 21/4049; A63B 22/0015; A63B 22/0017; A63B 22/0046; A63B 22/0048; A63B 22/0087; A63B 22/0089; A63B 22/02; A63B 22/0235; A63B 22/0285; A63B 23/035; A63B 23/03516; A63B 23/04; A63B 23/0405; A63B 23/047; A63B 23/0482; A63B 23/0494; A63B 69/0028; A63B 69/0057; A63B 69/0059; A63B 69/0064; A63B 71/0036; A63B 71/0054; A63B 71/0063; A63B 71/0072; A63B 71/0081; A63B 2208/0204; A63B 2210/00; A63B 2210/50; A63B 2225/09; A63B 2225/093

See application file for complete search history.

(56) References Cited

U.S. PATENT DOCUMENTS

| | | | | |
|---|---|---|---|---|
| 5,704,880 | A * | 1/1998 | Amatulle | A63B 22/02 482/124 |
| 5,919,119 | A * | 7/1999 | Bohmer | A63B 22/02 482/54 |
| 6,059,696 | A * | 5/2000 | Bohmer | A63B 22/02 482/54 |
| 6,139,476 | A | 10/2000 | Gallant | |
| 6,264,584 | B1 * | 7/2001 | Bass | A63B 69/0064 482/54 |
| 6,454,679 | B1 * | 9/2002 | Radow | A63B 22/0235 482/4 |
| 6,482,128 | B1 * | 11/2002 | Michalow | A63B 69/0028 482/100 |
| 6,575,876 | B1 * | 6/2003 | Phelps-McMillon | A63B 22/0235 482/51 |
| 6,764,429 | B1 * | 7/2004 | Michalow | A63B 69/0028 482/100 |
| 8,257,232 | B2 * | 9/2012 | Albert | A63B 69/0064 482/54 |
| 9,364,735 | B2 * | 6/2016 | Beane | A63B 69/0064 |
| 9,814,930 | B2 * | 11/2017 | Manzke | A63B 22/02 |
| 9,914,012 | B2 * | 3/2018 | Walter | A63B 21/4039 |
| 10,493,315 | B2 * | 12/2019 | Rubin | A63B 21/4035 |
| 2003/0004038 | A1 * | 1/2003 | Wroclawsky | A63B 22/02 482/54 |
| 2004/0087418 | A1 * | 5/2004 | Eldridge | A63B 21/157 482/54 |
| 2004/0116253 | A1 * | 6/2004 | Radow | A63B 22/0235 482/8 |
| 2008/0070757 | A1 | 3/2008 | Albert | |
| 2010/0016127 | A1 * | 1/2010 | Farnsworth | A63B 21/00072 482/54 |
| 2010/0113227 | A1 | 5/2010 | Habing | |
| 2010/0279827 | A1 * | 11/2010 | Farnsworth | A63B 22/02 482/54 |
| 2011/0237399 | A1 * | 9/2011 | Toback | A63B 5/16 482/8 |
| 2012/0295769 | A1 * | 11/2012 | Pennington | A63B 69/20 482/54 |
| 2013/0035208 | A1 * | 2/2013 | Dalebout | A63B 71/0622 482/8 |
| 2013/0263418 | A1 * | 10/2013 | Johnson, Jr. | A63B 22/02 29/402.08 |
| 2015/0080187 | A1 * | 3/2015 | Beane | A63B 69/0064 482/51 |
| 2016/0096064 | A1 * | 4/2016 | Gatti | A63B 22/02 482/54 |
| 2016/0317866 | A1 * | 11/2016 | Fung | G06F 1/163 |
| 2016/0346596 | A1 * | 12/2016 | Manzke | A63B 21/00069 |
| 2016/0346598 | A1 | 12/2016 | Manzke et al. | |
| 2017/0136289 | A1 * | 5/2017 | Frank | A63B 71/0054 |
| 2017/0225023 | A1 * | 8/2017 | Crist | A63B 21/00069 |

* cited by examiner

GYMNASTIC MACHINE HAVING A SLIDING BELT PROVIDED WITH A RESISTING DEVICE TO THE MOTION OF THE USER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present invention relates to a sliding belt gymnastic machine equipped with a device resistant to the user's motion, used in particular during the execution of a gymnastic exercise.

More in specifically, the invention concerns a passive sliding belt gymnastic machine, i.e. a non-motorized belt, moved by the user's legs push. The belt can be braked by the action of an motor with the additional braking function, or by the action of a brake, which exerts a variable resistance on the belt itself, studied and designed in particular for performing gymnastic exercises, referred to as "pulling" exercises, wherein the user moves the walking belt with the legs, having the abdomen constrained to the resistant device and the arms free to move in a coordinated manner with the movement of the legs, but which can be used for any exercise, for which it is required the movement of a passive sliding belt.

In the following, the description will be directed to a passive sliding belt machine for the execution of "pulling" gymnastic exercises, but it is apparent that it must not be considered limited to this specific use.

Description of the Related Art

As is well known, there are currently passive sliding belt exercise machines comprising devices that can be worn by a user to oppose resistance to the user's motion during the gymnastic exercise, such as running on the spot.

The resistant device used is usually installed on a structure outside the exercise machine, positioned behind the user during the gymnastic exercise.

The use of said external structure involves a remarkable overall bulk within the space, wherein the exercise machine is installed.

Moreover, in case of user's accidental fall, the user could hit against the external structure, thus causing damage due to the impact.

There are other known gymnastic machines, in which said resisting device is coupled with the supporting structure or to the frame of the exercise machine and is worn by the user in correspondence with the lower limbs.

It is apparent that coupling the resisting device to the user's legs makes difficult the gymnastic exercise to be performed, since the user has the legs placed under the resisting device.

SUMMARY

In light of the above, it is therefore object of the present invention that of providing an exercise machine, equipped with a resistant device that has a reduced encumbrance.

Another object of the invention is to provide an exercise machine provided with a resisting device, which only constrains the user's abdomen and leaves the lower and upper limbs free to move in a coordinated manner with each other, an essential condition for performing an accelerating movement, and thus ensuring the correct execution of the exercise.

Another object of the invention is to provide an exercise machine safe for the user, even in case of accidental falls from the sliding belt.

A further object of the invention is providing a gymnastic machine provided with a resisting device that can be coupled with the machine so as to have a free space for easy access to the exercise machine, also laterally, without encumbrance.

It is therefore specific object of the present invention a gymnastic machine of the type having a closed circuit sliding belt comprising a base structure, a sliding belt, sliding according to a sliding direction installed on said base structure upon which a user performs a gymnastic exercise, a supporting structure coupled to said base structure, a first and a second handle for supporting said user, coupled to said supporting structure, a resisting device wearable by the user, wherein each of said first and a second handle comprises a respective coupling member for coupling with said resisting device.

Further according to the invention, said base structure comprises a frame, comprising a first and a second end, on which said sliding belt is installed, sliding according to a sliding direction from said first end towards said second end of said frame, and in that said first and second handle are each provided with a first end, fixed to said supporting structure in correspondence of said first end of said frame, and of a second end, whose orthogonal projection on said sliding belt falls in correspondence of the half or two-thirds of said base structure.

Preferably according to the invention, said resisting device is deformable according to the position taken by the user on said sliding belt during the execution of the gymnastic exercise.

Still according to the invention, said resisting device exercises a force on the user in the opposite direction to the user's running direction during the execution of the gymnastic exercise.

Further according to the invention, said coupling member is a lever which can be coupled to the respective second end, of each of said first and second handle.

Preferably according to the invention, said lever is provided with a first end, which can be coupled to each of said first and second handle, and a second free end on which a through hole is provided for coupling with said resisting device.

Still according to the invention, said lever is coupled to the respective second end of each of said first and second handle, by means of respective friction elements which exercise a friction to the rotation of said lever.

Further according to the invention, said gymnastic machine may comprise a fixed screw integral with the respective second ends of each of said first and second handle, on said first end of said lever is obtained a through hole in which said fixed screw goes through, about which said lever can rotate, and said friction elements are arranged between said through hole and said fixed screw.

Preferably according to the invention, on said second ends of each of said first and second handle, a cavity is obtained, and said lever moves from a rest position, in which it is provided within said cavity, to a working position in which it is raised with respect to said second ends of each of said first and second handle and it is external to said cavity.

Finally according to the invention, said coupling member is a through ring or a hook which can be coupled to each of said first and second handle, for coupling with said resisting device.

The present invention will be now described, for illustrative but not limitative purposes, according to its preferred embodiments, with particular reference to the figures of the enclosed drawings, wherein:

BRIEF DESCRIPTION OF THE DRAWINGS

In the various figures, similar parts will be indicated by the same reference numbers.

DETAILED DESCRIPTION OF THE PREFERRED EMBODIMENT

Referring to FIGS. 1-5, the sliding belt gymnastic machine provided with a device resistant to the user's motion object of the present invention comprises several embodiments.

Figure 1:
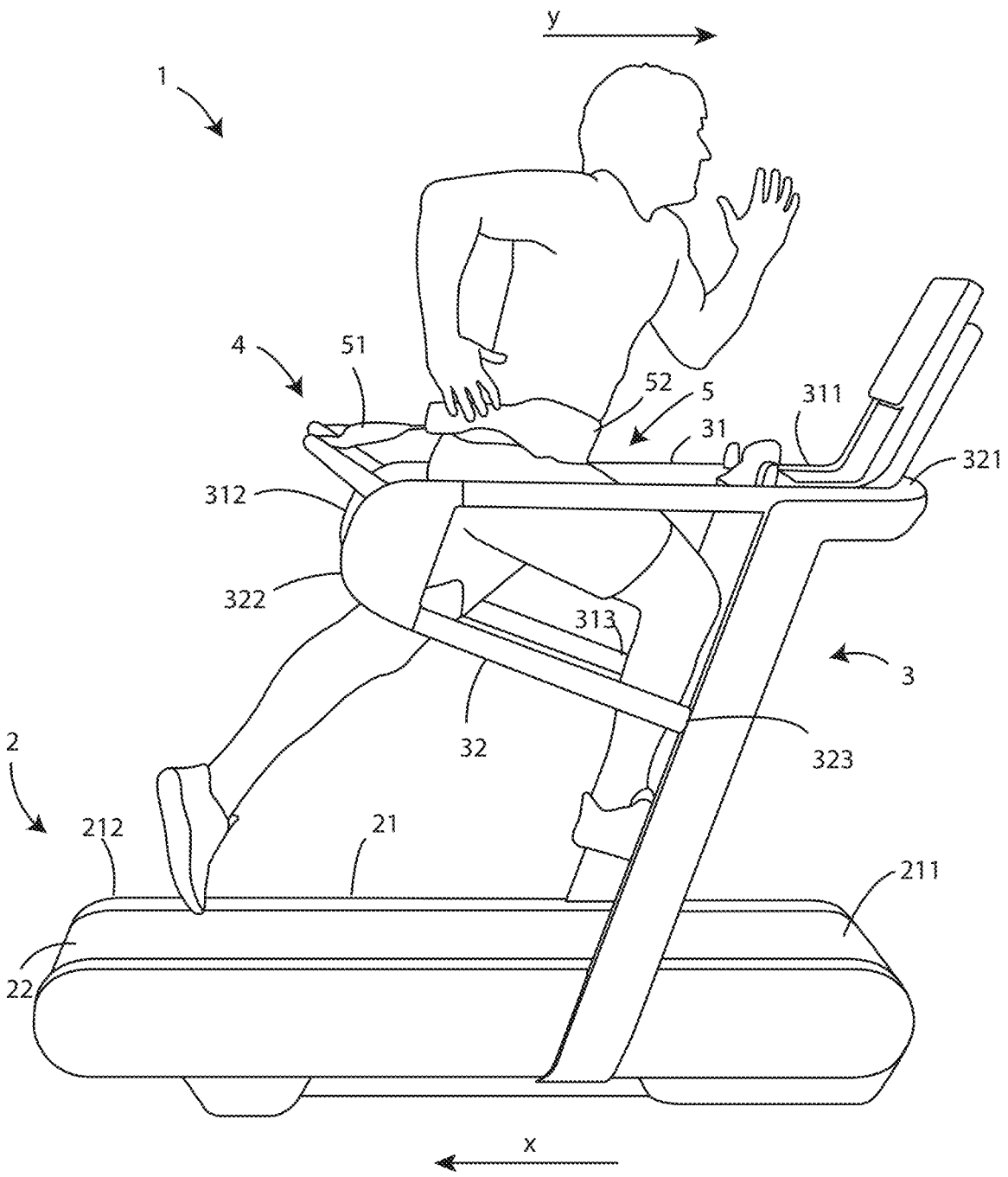
FIG. 1 shows a side view of the sliding belt exercise machine provided with a device resistant to the user's motion, object of the present invention.
Figure 2:
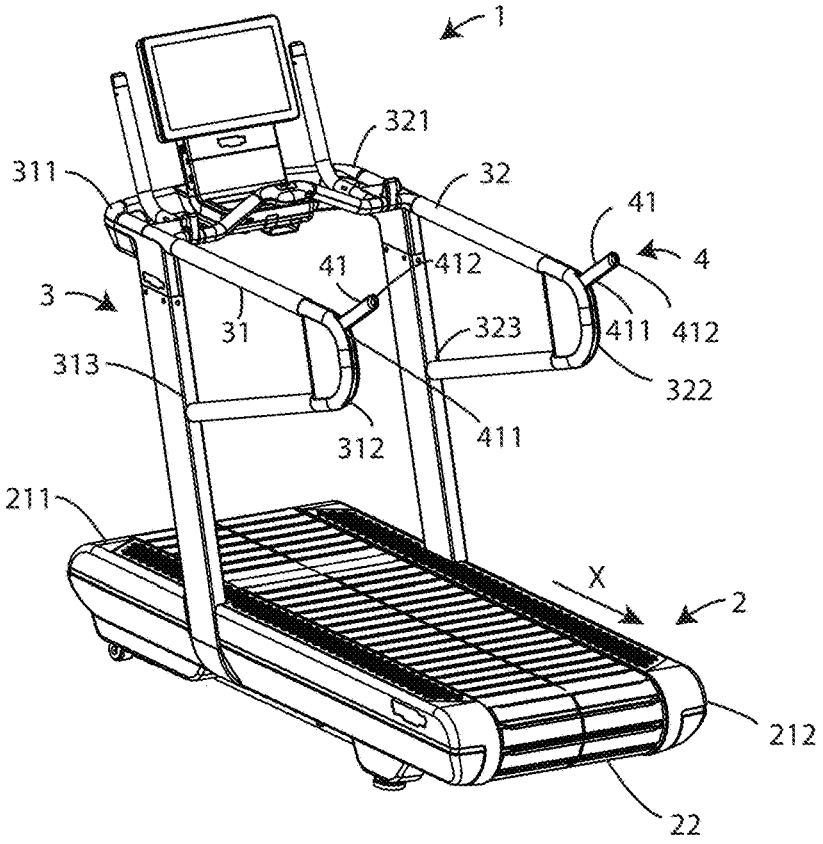
FIG. 2 shows a front perspective view of the machine of FIG. 1.
Figure 3:
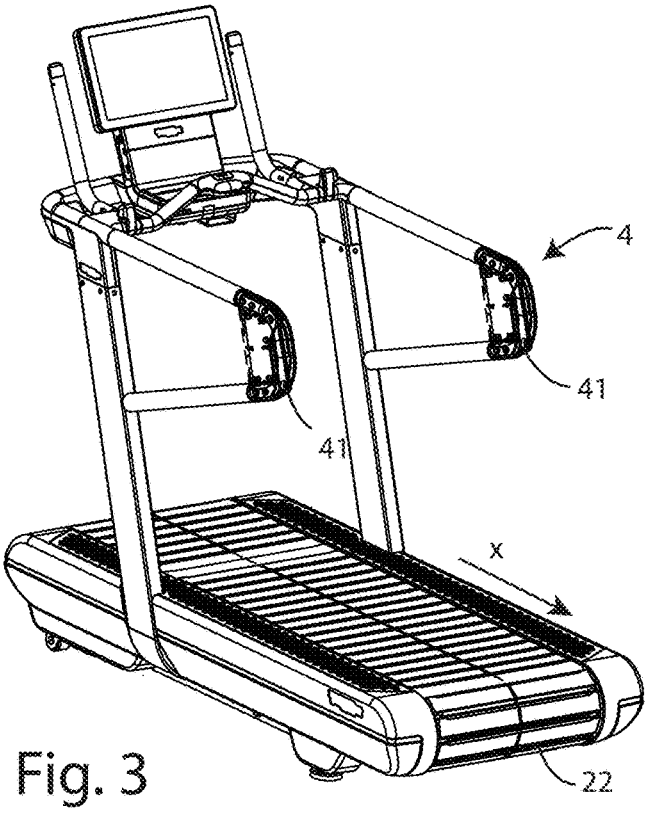
FIG. 3 shows a further front perspective view of the machine of FIG. 1 with a detail without a covering casing.
Figure 4:
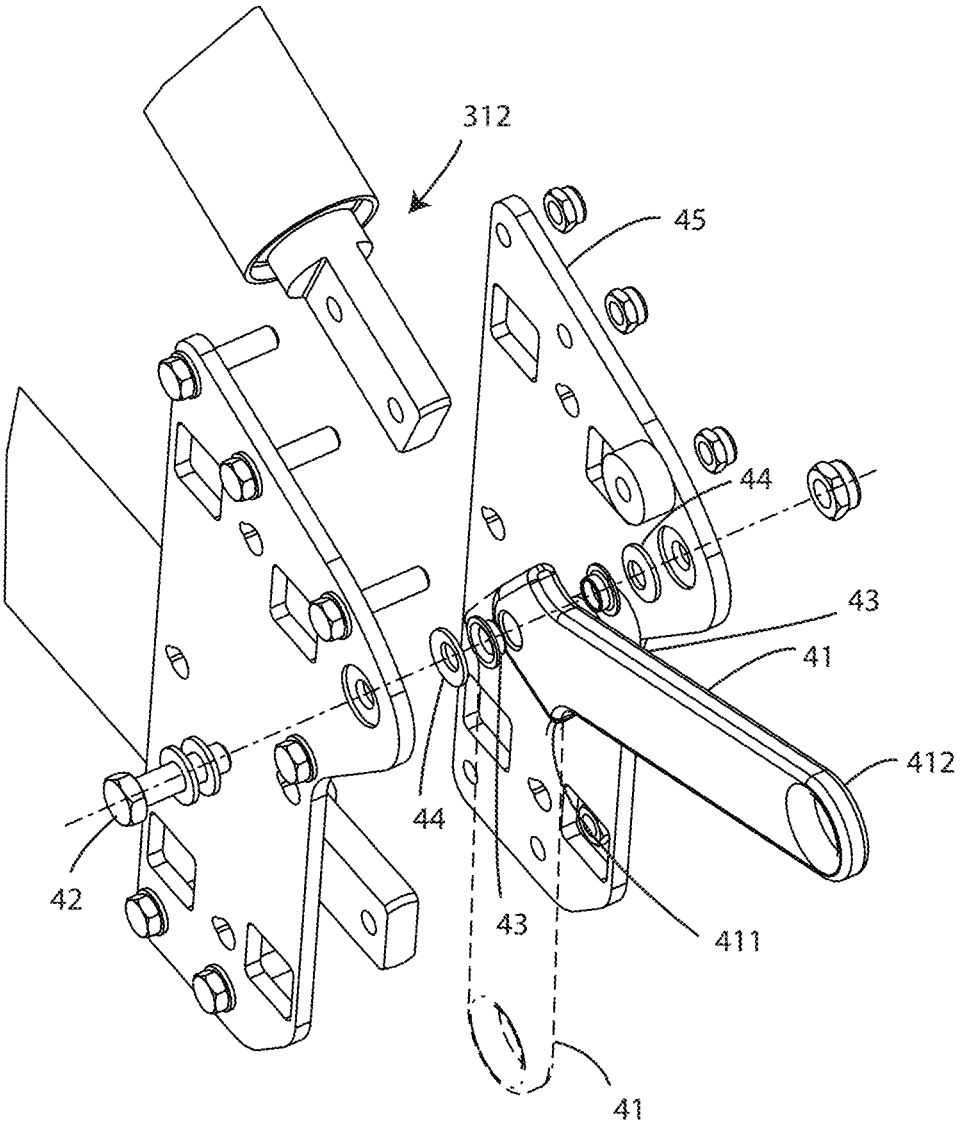
FIG. 4 shows an exploded view of the detail of FIG. 3.
Figure 5:
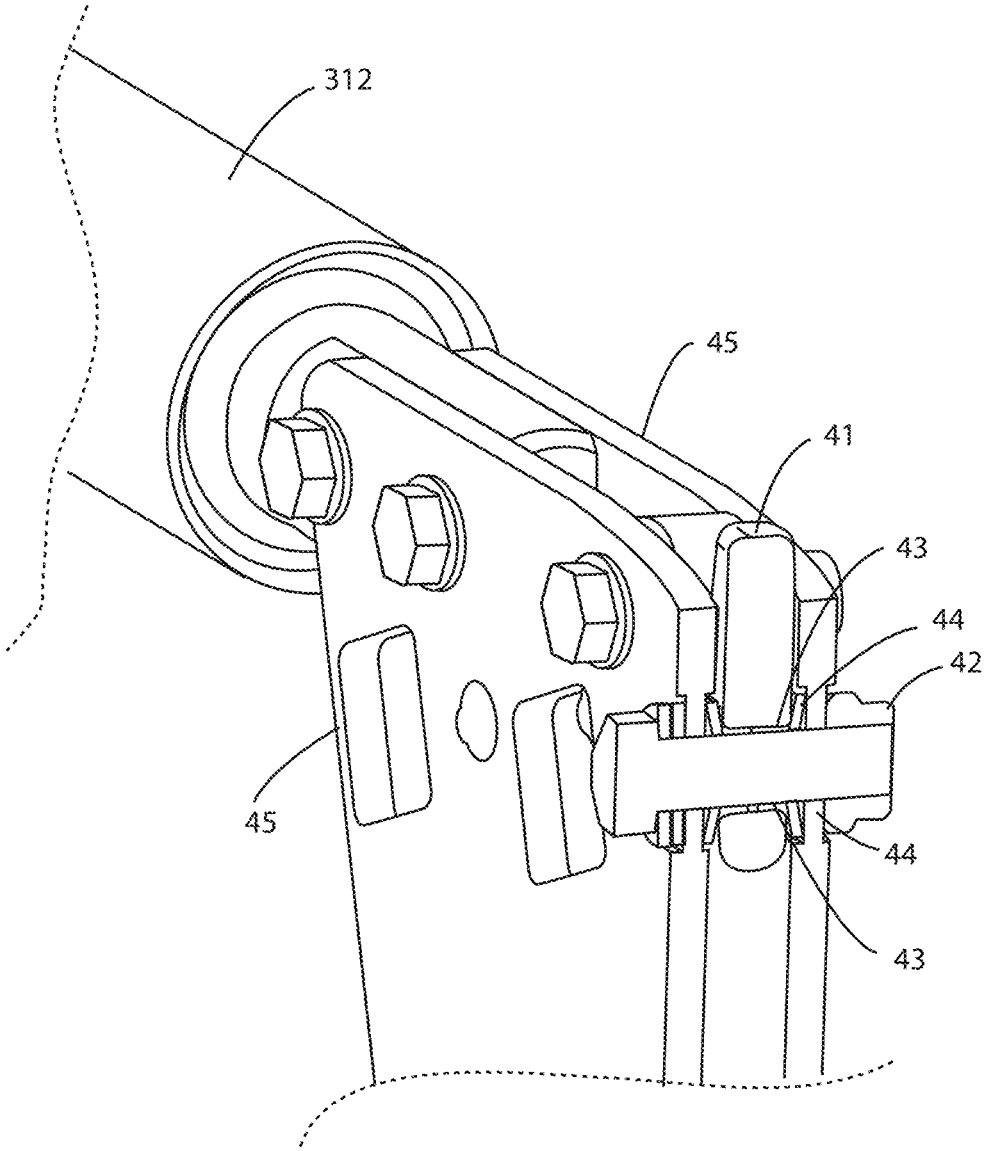
FIG. 5 shows a sectional perspective front view of the detail of FIG. 3.

The first preferred embodiment, shown in FIG. 1, concerns an exercise machine 1 comprising a base structure 2, having a frame 21, comprising a first 211 and a second 212 end, on which said sliding belt 22 is installed according to a sliding direction X, from said first end 211 to said second end 212, a resisting device 5, wearable by the user during the performance of the exercise, and a coupling member 4 between said exercise machine 1 and said resisting device 5.

Said sliding belt 22 comprises a plurality of strips placed side-by-side and coupled one next the other according to a direction transversal to that of the sliding direction X of said sliding belt 22.

Said sliding belt 22 can also be a continuous surface sliding belt.

Said sliding belt 22 is passive, since the exercise machine 1 is provided with a drive motor with additional braking function, or in the base structure 2 an adjustable brake is installed, which generates a variable resistance opposing the sliding of the sliding belt 22 according to a training program pre-set by a user, for example, simulating the race real condition with a parachute-type accessory, hooked to the user which, inflating, creates a resistance, which increases increasing the running speed.

The brake applied can be a magnetic or electromagnetic brake.

The sliding belt 22 provided with a motor can also be applied in active mode, i.e. the motor rotates the sliding belt 22 according to a training program preset by the user.

Therefore the user, in order to perform an exercise, typically runs on said sliding belt 22 according to a running direction Y, opposite to said sliding direction X of said sliding belt 22, overcoming all the inertia of the sliding belt 22, which is initially steady, and overcoming the frictions due to the sliding of the sliding belt 22 on said frame 21 and the resistance opposed by the adjustable brake, thus simulating a typical sprint of a running race.

Said gymnastic machine 1 comprises a supporting structure 3, coupled with said base structure 2, to which a first 31 and a second 32 curved handle are coupled for supporting said user during the ascending and desending phases of the exercise machine 1 or even during the development of the gymnastic exercise.

Curved handle means a handle 31, 32 having a substantially elongated shape, wherein the first end 311, 321 is coupled with the support structure 3 the second end 312, 322 is curved and is connected again with said support structure 3 by a third end 313, 323.

Said second curved end 312, 322 is positioned approximately at the half or two-thirds of said base structure 2, in particular, its orthogonal projection on said sliding belt 22 falls to half or two-thirds of said support structure 2.

In said curved second end 312, 322 of each of said first 31 and second 32 handle a cavity is formed, defined by a pair of lateral flanges 45, in which is fixed, on each of said first 31 and second 32 handle, the respective coupling member 4 between said exercise machine 1 and said resisting device 5.

Said coupling member 4 comprises a lever provided with a first end 411 and a second 412 free end.

A lever 41 is coupled with each one of said second curved ends 312, 322 of each one of said first 31 and second handle 32.

In particular, on said first end 411 of said lever 41 a through hole is obtained, in which a fixed screw 42 passes, around which said lever 41 can rotate.

Said fixed screw 42 is integral with said pair of lateral flanges 45 of said second curved end 312, 322 of each of said first 31 and second 32 handle.

Between said through hole and said screw 42 a pair of bushing 43 are arranged, fixed to said pressure lever 41, and friction elements, in particular a pair of disc springs 44, interposed between said pair of bushings 43 and said pair of flanges 45.

The fixed screw 42 packages and closes the lever 41 between the pair of flanges 45 with the interposition of said two disc springs 44 elastically deformed.

On said second free end 412 of said lever 41 a through hole is obtained for the passage of a hook, which connects said resisting device 5.

Said lever 41 is movable from a rest position, wherein it is arranged within said cavity, when the user does not perform the pulling gymnastic exercise with the resisting device 5, to a working position, wherein it is lifted and exits from said cavity during the performing of the gymnastic exercise.

In the working position, said first end 411 of said lever 41 abuts against an end stroke surface of the respective second curved end 311, 312, which it is coupled with.

The transition from the rest position to the working position, and vice versa, is manual and it is performed by the user before performing the gymnastic exercise, bringing said lever 41 from said rest position to said working position, overcoming the friction exerted by said pair of disc springs 44 on said lever 41, therefore the movement of the lever 41 is frictioned by said pair of disc springs 44.

Said lever 41 could also include a known quick coupling and releasing element for keeping the lever 41 in a fixed intermediate working positions during the performance of the gymnastic workout and selectable by the user before performing the gymnastic workout, on the basis of the height of his or her own abdomen.

Said resisting device 5 comprises a pair of hooks 51, each one hooking to the respective through hole of said second free end 412 of said lever 41, and a belt 52, which can be worn by the user.

Said resisting device 5 can be deformed, in particular it is elastic and, depending on the position assumed by the user on said sliding belt 22 during the performing of the gymnastic exercise, and generates a resisting force on the user, having a direction opposite to the user's running direction Y.

Figure 6:
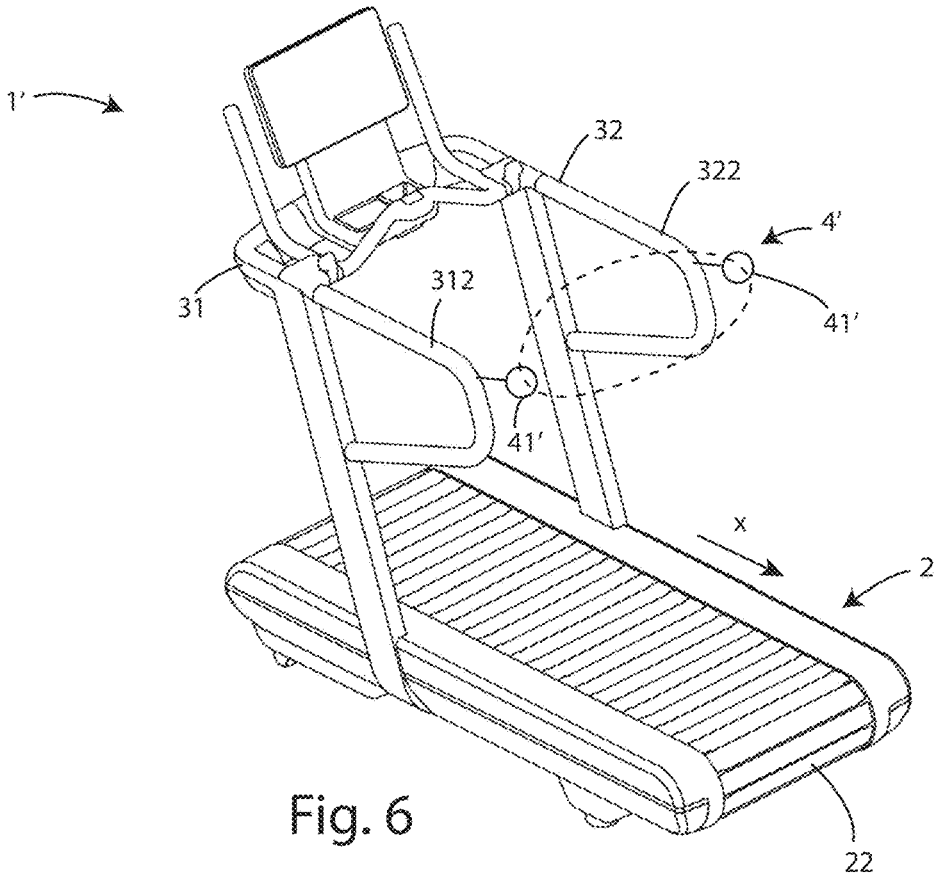
FIG. 6 shows a front perspective view of a second embodiment of the machine of FIG. 1.

Referring now to FIG. 6, in a second embodiment of said exercise machine 1', for each one of first 31 and second 32 handle, said coupling member 4' is a through ring or hook 41', that can be coupled to said second curved end 312, 322 respectively of each of said first 31 and second 32 handle.

The respective hook of the pair of hooks 51 of said resisting device 5 is inserted in said through ring 41'.

Said through ring 41' may be fixed or movable with respect to the end, which it is fixed to, without however falling out of the scope of protection of the present invention.

Figure 7:
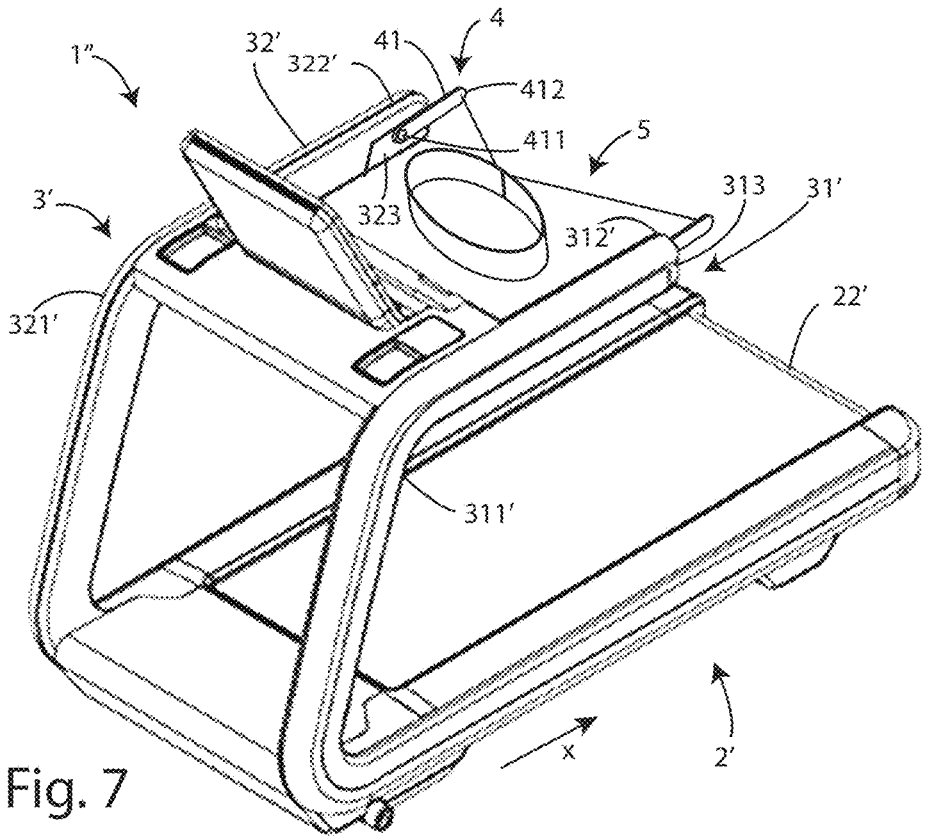
FIG. 7 shows a rear perspective view of a third embodiment of the machine of FIG. 1.

Referring now to FIG. 7, a third embodiment of the exercise machine 1" object of the present invention differs from the first embodiment, for the structure of said first 31' and second 32' handle, wherein said second end 312' and 322' is straight and not curved, therefore it does not join with said support structure 3.

In this case, for each one of said first 31' and second 32' handle, in correspondence of the respective second ends 312' and 322' a cavity 313 and 323 is provided, in which said lever 412 arranges in rest position.

Moreover, in this embodiment, the fixed element 42 is integral with said first ends 312', 322' of each of said first 31' and second 32' handle.

Figure 8:
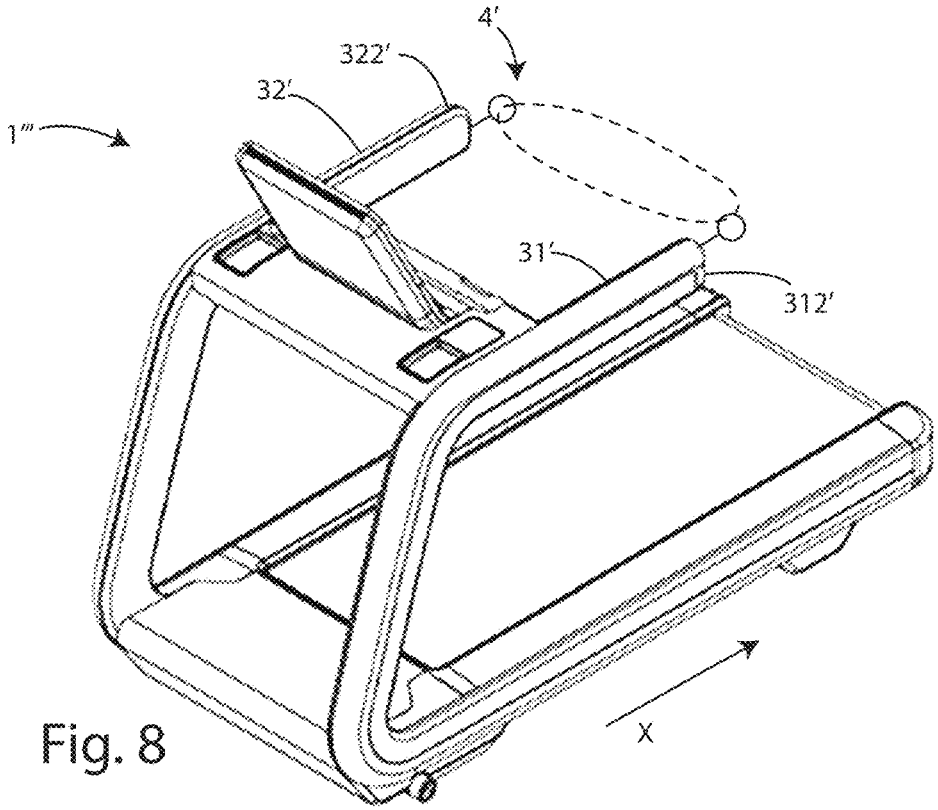
FIG. 8 shows a rear perspective view of a fourth embodiment of the machine of FIG. 1.

Referring now to FIG. 8, a fourth embodiment of the exercise machine 1'" according to the present invention differs from the third embodiment, for the structure of the coupling member 4' comprising a through ring 41' coupled to said second ends 312', 322' respectively of each of said first 31' and second 32' handle.

Figure 9:
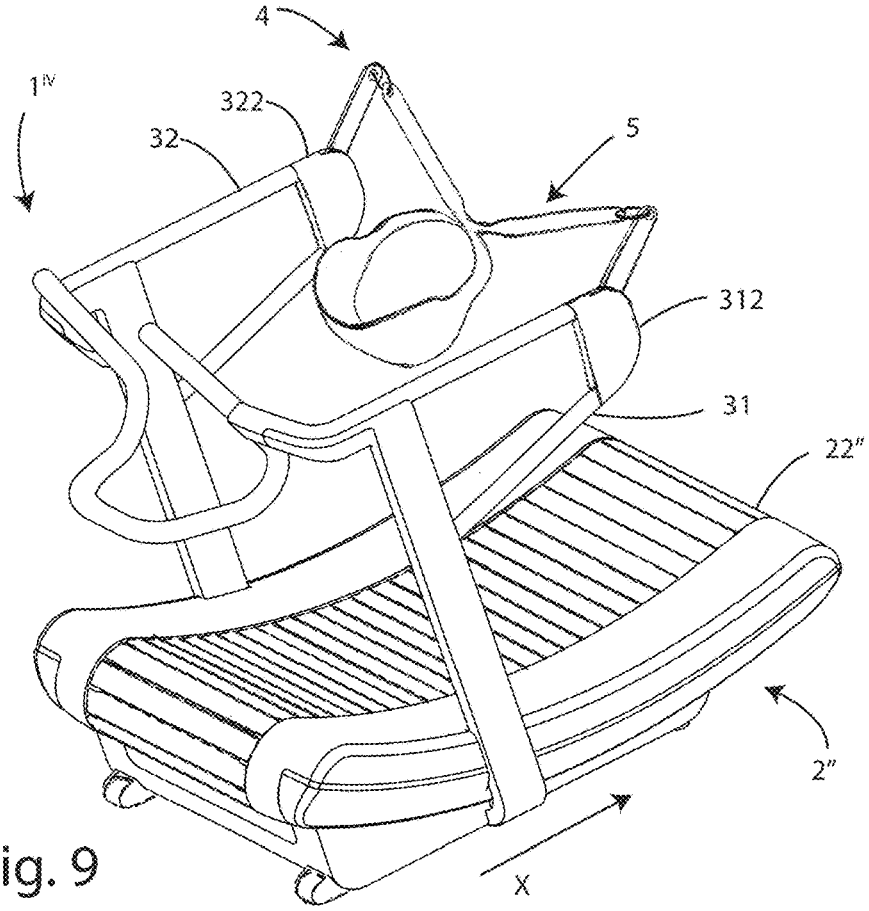
FIG. 9 shows a rear perspective view of a fifth embodiment of the machine of FIG. 1.

Referring now to FIG. 9, a fifth embodiment of the exercise machine $\mathbf{1}^{IV}$ object of the present invention differs from the first embodiment, for the support structure 2".

In this fifth embodiment, the support structure 2" is curved and the sliding belt 22" comprises a plurality of strips placed side-by-side and coupled one next to the other according to a direction transverse to the sliding direction X of said sliding belt 2.

The shape of the handles 31 and 32 and of the coupling member 4 structure are unchanged with respect to the previously described first embodiment.

Figure 10:
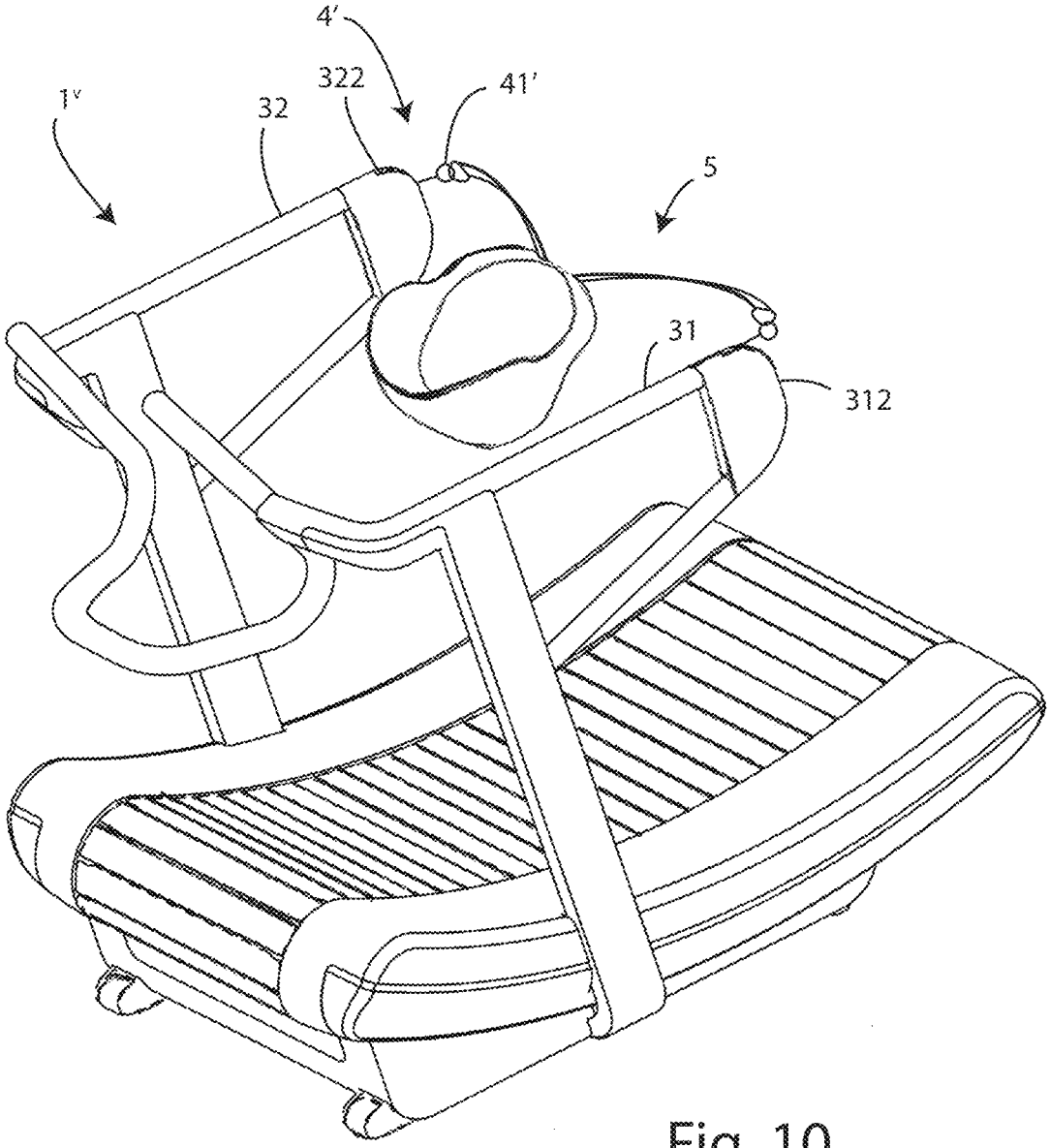
FIG. 10 shows a rear perspective view of a sixth embodiment of the machine of FIG. 1.

Referring now to FIG. 10, a sixth embodiment of the exercise machine $\mathbf{1}^{V}$ object of the present invention differs from the fifth embodiment solely for the structure of the coupling member 4', which comprises a through ring 41' that can be coupled to said second end 312, 322 respectively of each one of said first 31 and second 32 handle.

For all the embodiments 1", 1'", $\mathbf{1}^{IV}$ and $\mathbf{1}^{V}$ described above, the sliding belt 22, 22', 22" may be a mat, having therefore a continuous surface or a belt comprising a plurality of strips.

Moreover, for all the embodiments 1", 1'", $\mathbf{1}^{IV}$ and $\mathbf{1}^{V}$ described above, the sliding belt 22, 22', 22" can operate passively, thus being controlled by a drive motor with the additional braking function, or by an adjustable brake that generates a variable resistance, or can operate actively, i.e. the motor rotates the sliding belt 22, 22', 22" according to a training program preset by the user.

Alternatively, for all the embodiments 1", 1'", $\mathbf{1}^{IV}$ and $\mathbf{1}^{V}$ described above using a sliding belt 22, 22', 22" in manual mode is also possible, namely without motor and brake.

The operation of the exercise machine 1, 1", 1'", $\mathbf{1}^{IV}$ and $\mathbf{1}^{V}$ described above is as follows.

When a user aims to perform a "pulling" gymnastic exercise to train for example a typical running sprint, he or she accesses said exercise machine 1 by positioning himself or herself on said sliding belt 22 and wearing said resisting device 5.

The user moves said coupling member 4, and in particular said lever 41, from said rest position to said working position, which remains fixed during the performing of the exercise, due to the friction exerted by said pair of disc springs 44 on said lever 41 and then, for the force exerted by said resisting device 5 due to the thrust of the user on said belt 52.

The user starts moving said sliding belt 22 with the legs, overcoming the initial inertia, the frictions due to the sliding of the running belt 22 on said frame 21 and the adjustable force exerted by the brake.

The sliding belt 22 moves according to the sliding direction X, while the user moves according to a running direction Y, opposite to said sliding direction X.

Said resisting device 5 then exerts a resisting force on the user having a direction opposite to the running direction Y and therefore according to the sliding direction X of said sliding belt 22.

In this way, the user has the abdomen constrained and stabilized by the resisting device 5, and therefore the user can freely move the arms in a manner coordinated with the legs, to perform correctly the gymnastic exercise, even at high acceleration.

In fact, the correct performance of the gymnastic exercise consists of moving the right arm together with the left leg, alternately with the movement of the left arm together with the right leg.

Without the resisting device 5 the user could not correctly perform the gymnastic exercise.

The operation of the further embodiments of the exercise machine described above is analogous to the operation of the first embodiment just described.

As is evident from the description above, the gymnastic machine 1 object of the present invention, on which performing "pulling" exercises by means of a resisting device, has a small encumbrance and it is safe in case of accidental falls of the user while performing the gymnastic exercise.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A gymnastic machine having a sliding belt, the gymnastic machine comprising:

a base structure;

the sliding belt being slidable according to a sliding direction (X), the sliding belt installed on said base structure and configured such that a user performs a gymnastic exercise thereupon;

a supporting structure coupled to said base structure;

a first and a second handle for supporting said user, the first and second handles coupled to said supporting structure; and a resisting device wearable by the user, wherein each of said first and said second handle comprises a respective coupling member for coupling with said resisting device, wherein said base structure comprises a frame, the frame comprising a first and a second end on which said sliding belt is installed, the sliding belt being slidable according to the sliding direction (X) from said first end towards said second end of said frame, wherein said first and second handles are each provided with a first end and a second end, the first end of each of the first and second handles fixed to said supporting structure, the second end of each of the first and second handles having an orthogonal projection on said sliding belt, wherein the orthogonal projections are aligned with a region of said base structure corresponding to a half or two-thirds distance between the first and second ends of the frame, and wherein the half or two-thirds distance is measured from the first end of the frame, wherein said respective coupling member is a lever configured to be coupled to the respective second end of each of said first and second handles, and wherein said levers are each provided with a first end, the first ends of said levers configured to be respectively coupled to said first and second handles, and a second free end on which a through hole is provided for coupling with said resisting device.

2. The gymnastic machine according claim 1, wherein said resisting device is configured to be deformable according to a position taken by the user on said sliding belt.

3. The gymnastic machine according to claim 1, wherein said resisting device is configured to exert a force on the user in a direction opposite to a running direction (Y) of the user.

4. The gymnastic machine according claim 1, wherein said levers are respectively coupled to the second ends of said first and second handles by friction elements which respectively exert a friction to rotation of said levers.

5. The gymnastic machine according to claim 4, further comprising:

a pair of fixed screws respectively integral with the second ends of said first and second handles, wherein each fixed screw is respectively insertable through a through hole in the first end of each lever, each lever being rotatable about the respective fixed screw, and wherein said friction elements are arranged between said respective through holes in the first ends of said levers and said respective fixed screws.

6. The gymnastic machine according to claim 1, wherein:

a pair of cavities are respectively located in said second ends of said first and second handles; and said levers are respectively movable between a rest position and a working position, wherein in said rest position, said levers are respectively provided within said pair of cavities, and wherein in said working position, said levers are respectively raised with respect to said second ends of said first and second handles and are respectively external to said pair of cavities.

7. The gymnastic machine according to claim 1, wherein each of said respective coupling members is a through ring or a hook, said respective coupling members configured to be respectively coupled to said first and second handles for coupling with said resisting device.

* * * * *